US008899788B2

(12) United States Patent
Lin et al.

(10) Patent No.: US 8,899,788 B2
(45) Date of Patent: Dec. 2, 2014

(54) LIGHT SOURCE FIXING DEVICE, LIGHT SOURCE ASSEMBLY AND ASSEMBLING METHOD THEREOF

(75) Inventors: Po-lem Lin, Shenzhen (CN); Chengwen Que, Shenzhen (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 492 days.

(21) Appl. No.: 13/260,376

(22) PCT Filed: May 24, 2011

(86) PCT No.: PCT/CN2011/074611
§ 371 (c)(1), (2), (4) Date: Sep. 25, 2011

(87) PCT Pub. No.: WO2012/116523
PCT Pub. Date: Sep. 7, 2012

(65) Prior Publication Data
US 2012/0314431 A1 Dec. 13, 2012

(30) Foreign Application Priority Data
Mar. 1, 2011 (CN) ..... 2011 1 0048557

(51) Int. Cl.
*F21V 29/00* (2006.01)
*F21V 19/00* (2006.01)

(52) U.S. Cl.
CPC ..... *F21V 19/0045* (2013.01)
USPC ..... 362/249.02; 362/294; 362/373

(58) Field of Classification Search
CPC ..... F21V 29/004; F21V 19/00; F21V 19/001; F21V 19/0015; F21V 19/03; F21V 19/0035; F21Y 2103/003; F21K 9/30; F21S 4/00; F21S 4/003; F21S 4/008; H01L 23/40; H01L 23/4093; H01L 24/72
USPC ..... 362/218, 294, 373, 249.01, 249.02, 362/219, 382, 217.01, 220, 217.1, 217.12, 362/217.13, 217.14, 217.16, 217.17; 257/712, 718, 719, 720
See application file for complete search history.

(56) References Cited

U.S. PATENT DOCUMENTS

| | | | | |
|---|---|---|---|---|
| 6,791,183 | B2 * | 9/2004 | Kanelis | 257/718 |
| 2005/0174740 | A1 * | 8/2005 | Hayakawa | 361/718 |
| 2007/0047207 | A1 * | 3/2007 | McPhee | 361/704 |
| 2007/0109751 | A1 * | 5/2007 | Mayer et al. | 361/719 |

FOREIGN PATENT DOCUMENTS

| | | | |
|---|---|---|---|
| CN | 2587063 | Y | 11/2003 |
| CN | 1731246 | A | 2/2006 |
| CN | 1731250 | A | 2/2006 |
| CN | 101000423 | A | 7/2007 |

(Continued)

*Primary Examiner* — Thomas M Sember
(74) *Attorney, Agent, or Firm* — Cheng-Ju Chiang

(57) ABSTRACT

The present invention provides a light source fixing device for fixing a light emitting element. The light emitting element comprises a light source and a supporting plate for supporting the light source. The light source fixing device comprises a heat dissipating support which comprises a receiving recess. The receiving recess is adapted to receive the supporting plate. The light source fixing device further comprises an elastic element disposed in the receiving recess, and the elastic element is adapted to apply an elastic force on the supporting plate so that the supporting plate is fixed in the receiving recess. The present invention further provides a light source assembly and an assembling method thereof. The light source assembly features a simple assembling process, high reliability and a low cost.

15 Claims, 5 Drawing Sheets

(56) References Cited

FOREIGN PATENT DOCUMENTS

| | | | |
|---|---|---|---|
| CN | 101109862 | A | 1/2008 |
| CN | 101295098 | A | 10/2008 |
| CN | 201133990 | Y | 10/2008 |
| CN | 101634415 | A | 1/2010 |
| CN | 201489240 | U | 5/2010 |
| CN | 201513748 | U | 6/2010 |
| CN | 201571290 | U | 9/2010 |
| CN | 201621525 | U | 11/2010 |

* cited by examiner

LIGHT SOURCE FIXING DEVICE, LIGHT SOURCE ASSEMBLY AND ASSEMBLING METHOD THEREOF

TECHNICAL FIELD

The present invention generally relates to the field of display, and more particularly, to a light source fixing device, a light source assembly and an assembling method of the light source assembly.

BACKGROUND

With rapid development of the electronic product technologies, light emitting diodes (LEDs) have found increasingly wider application in, for example, the field of LED illumination, the field of liquid crystal display (LCD) and various industrial control display apparatuses.

In the field of liquid crystal display, a liquid crystal display device usually comprises a backlight module and a liquid crystal display panel superposed thereon. The liquid crystal panel cannot emit light by itself, so the backlight module is used as a light source in the liquid crystal display for driving the liquid crystal display panel display images. As a kind of typical point light source device, LEDs are often used in the backlight module as a key component. usually, a plurality of LEDs used as point light source are arrayed on the surface of a printed circuit board (PCB) to form an LED light bar, and the LEDs are driven by the PCB to emit light to form a bar-shaped line light source.

As is well known, the LED radiates heat during operation, in order to ensure that the LED operates within a preset temperature range, a heat dissipating component must be provided to form a light source assembly so that the heat generated by the LED during operation can be effectively and timely dissipated. Therefore, how to design a light source assembly with a desirable heat dissipating efficiency has become a great concern in the art.

A perspective view illustrating a structure of a prior art light source assembly is shown in FIG. 1. The light source assembly 1 comprises a plurality of LEDs 11, a PCB 13 and a heat sink 15. The array of the LEDs 11 is disposed on the surface of the PCB 13. The heat sink 15 is fixed to the PCB 13 by screws to form the light source assembly 1.

When the light source assembly 1 is working, the LEDs 11 generate massive heat which causes a sudden rise in the temperature of the whole PCB 13. Due to the phenomenon of thermal expansion and contraction effect, the whole PCB 13 tends to be deformed to cause a loose contact between the PCB 13 and the heat sink 15, which reduces the contact area and significantly degrades the heat dissipation efficiency. Furthermore, as assembled by use of screws, usually a tight fit cannot be achieved between the PCB 13 and the heat sink 15 due to inaccurate aligning operations performed by workers; which also reduces the contact area and significantly degrades the heat dissipation efficiency. More importantly, the use of the screwed structure leads to a large number of elements, a complex assembling process and an increased cost of the whole light source assembly 1.

Referring next to FIG. 2, there is shown a schematic side view of a structure of another light source assembly in the prior art. Likewise, the light source assembly 2 comprises a plurality of LEDs 21, a PCB 23 and a heat sink 25. The PCB 23 is fixedly adhered to the surface of the heat sink 25 directly by means of a thermally conductive adhesive layer 24.

In the light source assembly 2, although the use of the thermally conductive adhesive layer 24 simplifies the whole structure and the assembling process, there still exists the following problem: when the light source assembly 2 operates, the temperature of the thermally conductive colloid layer 24 increases with the temperature of the whole assembly, which causes aging and degradation in the adhesive performance of the chemical material of the thermally conductive colloid layer 24; this tends to cause loosing and falling off of the PCB 23 and the heat sink 25 from each other, thereby resulting in degraded heat dissipating performance and reliability of the product.

Accordingly, there exists a need in the art to provide an improved approach to fix a light source assembly.

SUMMARY OF THE INVENTION

In view of the problem that the aforesaid light source assembly requires a complex assembling process and has low reliability and a high cost, embodiments of the present invention provide a light source fixing device that features a simple assembling process, high reliability and a low cost, and further provide a light source assembly and an assembling method thereof.

To solve the aforesaid technical problem, an embodiment of the present invention provides a light source fixing device, which comprises a heat dissipating support. The heat dissipating support comprises a receiving recess, and the light source fixing device further comprises an elastic element disposed in the receiving recess.

In a preferred embodiment, the receiving recess has a trapezoidal or T-shaped cross section.

In a preferred embodiment, the receiving recess comprises a bottom surface and two opposite side surfaces, the bottom surface adjoins lower ends of the two side surfaces, an opening of the receiving recess is formed between upper ends of the two side surfaces, a distance between the lower ends of the two side surfaces is greater than a width of the opening, and each of the side surfaces is inclined or arcuated or is formed with a stepped structure from the upper end thereof to the lower end thereof.

In a preferred embodiment, a plurality of grooves is formed at the opening of the receiving recess.

In a preferred embodiment, the elastic element is a thermally conductive element.

An embodiment of the present invention further provides a light source assembly, which comprises a light emitting element and a light source fixing device. The light emitting element comprises a light source and a supporting plate for supporting the light source; the light source fixing device comprises a heat dissipating support which comprises a receiving recess; the receiving recess is adapted to receive the elastic element and the supporting plate; and the elastic element is adapted to apply an elastic force on the supporting plate so that the supporting plate is fixed in the receiving recess.

In a preferred embodiment, the receiving recess has a trapezoidal or T-shaped cross section.

In a preferred embodiment, the receiving recess comprises a bottom surface and two opposite side surfaces, the bottom surface adjoins lower ends of the two side surfaces, an opening of the receiving recess is formed between upper ends of the two side surfaces, a distance between the lower ends of the two side surfaces is greater than a width of the opening, and each of the side surfaces is inclined or arcuated or is formed with a stepped structure from the upper end thereof to the lower end thereof.

In a preferred embodiment, the light source is disposed adjacent to the opening of the receiving recess so that a light beam of the light source transmits from the opening.

In a preferred embodiment, a plurality of grooves is formed at the opening of the receiving recess, a plurality of protrusions is formed at sides of the supporting plate corresponding to the grooves of the receiving recess, and a profile of the protrusions matches with a profile of the grooves, the receiving recess is adapted to receive the supporting plate, the protrusions abut against an inner wall of the receiving recess, and the elastic element is adapted to apply an elastic force on the supporting plate so that the supporting plate is fixed in the receiving recess.

In a preferred embodiment, the elastic element is a thermally conductive element.

An embodiment of the present invention further provides an assembling method of a light source assembly, which comprises the following steps of: a placing step, in which a supporting plate of a light emitting element is placed into a receiving recess of a heat dissipating support via an opening of the receiving recess; and a pressing step, in which the supporting plate is used to press an elastic element in the receiving recess to cause elastic deformation of the elastic element and to have the supporting plate of the light emitting element fixed in the receiving recess, wherein the elastic element is adapted to apply an elastic force on the supporting plate of the light emitting element.

In a preferred embodiment, in the placing step, one side of the supporting plate is inserted into the receiving recess of the heat dissipating support slantwise via the opening of the receiving recess; and in the pressing step, the elastic element in the receiving recess is pressed to place the other side of the supporting plate into the receiving recess.

In a preferred embodiment, in the placing step, a supporting plate with protrusions at sides thereof is placed into the opening of the receiving recess with grooves in such a way that the protrusions are disposed into the grooves; and in the pressing step, the elastic element in the receiving recess is pressed and the supporting plate is pushed so that the protrusions are moved into the receiving recess and abut against an inner wall of the receiving recess.

In the light source fixing device and the light source assembly of the embodiments of the present invention, the receiving recess is directly disposed on the surface of the heat dissipating support as a holding structure, which can effectively fix the supporting plate and ensure that the supporting plate and the light source have the same relative positions relative to the heat dissipating support; meanwhile, the elastic element is additionally provided to elastically fix the supporting plate so as to prevent the supporting plate and the heat dissipating support from loosening and falling off. This can improve the reliability of the product and also avoid use of locking elements such as screws, thus reducing the number of elements to be assembled and simplifying the assembling process.

BRIEF DESCRIPTION OF THE DRAWINGS

The components in the drawings are not necessarily drawn to scale, the emphasis instead being placed upon clearly illustrating the principles of at least one embodiment of the present invention. In the drawings, like reference numerals designate corresponding parts throughout various views, and all the views are schematic.

DETAILED DESCRIPTION OF EMBODIMENTS

Reference will now be made to the drawings to describe preferred and exemplary embodiments of the present disclosure in detail.

To solve the technical problem that the prior art light source assemblies require a complex assembling process and have low reliability and a high cost, the present invention provides a light source fixing device, a light source assembly and an assembling method thereof with high reliability and a simple assembling process. Hereinafter, for purpose of description, a light emitting diode (LED) will be taken as an example of a light source to describe embodiments of the present invention with reference to the attached drawings.

Figure 1:
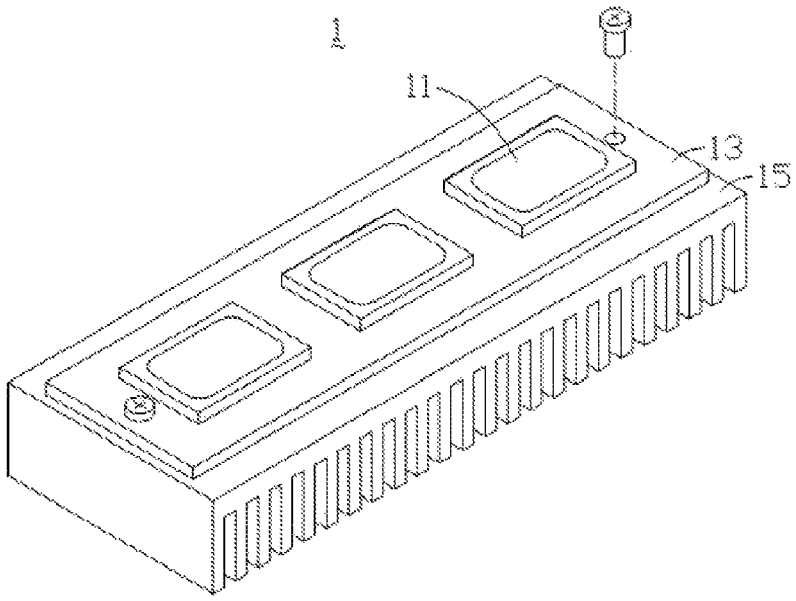
FIG. 1 is a schematic perspective view of a structure of a light source assembly in the prior art.
Figure 2:
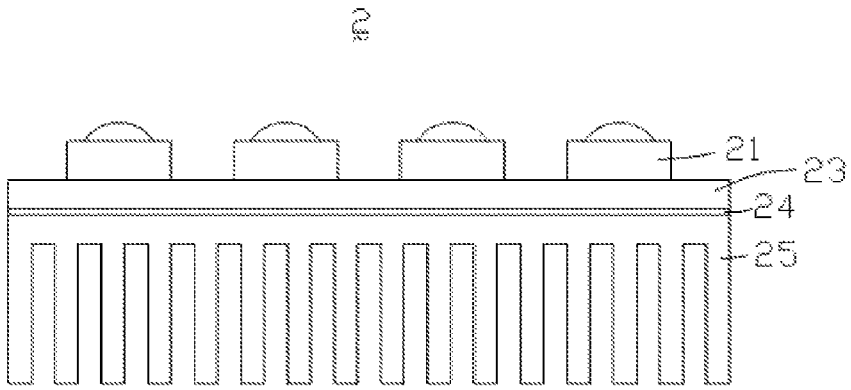
FIG. 2 is a schematic side view of a structure of another light source assembly in the prior art.
Figure 3:
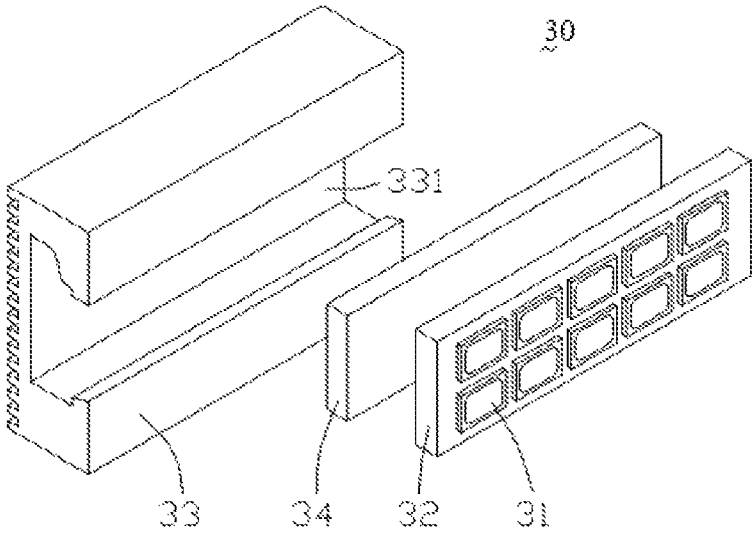
FIG. 3 is a schematic perspective exploded view of a light source assembly according to a first embodiment of the present invention.

Referring to FIG. 3, a light source assembly 30 according to a first embodiment of the present invention comprises a plurality of LEDs 31, a circuit board 32, a heat dissipating support 33 and an elastic element 34. The LEDs 31 and the circuit board 32 are collectively called a light emitting element.

The LEDs 31 are arranged in an array on a side surface of the circuit board 32. Each of the LEDs 31 is a point light source electrically connected to the circuit board 32. The circuit board 32 is a rigid printed circuit board (PCB) or a flexible PCB having a plurality of pads (not shown) and a printed circuit (not shown) disposed on a surface thereof. The pads are arranged in an array. Each of the pads corresponds to one of the LEDs 31; i.e., the LED 31 is welded onto the pad of the circuit board 32, correspondingly. The printed circuit on the surface of the circuit board 32 transmits an electric signal to the LED 31 via the pad to drive the LED 31. When the LEDs 31 arranged in an array operate, a bar-shaped light source with a uniform distribution of light intensity is formed as a light source of a backlight module.

Figure 4:
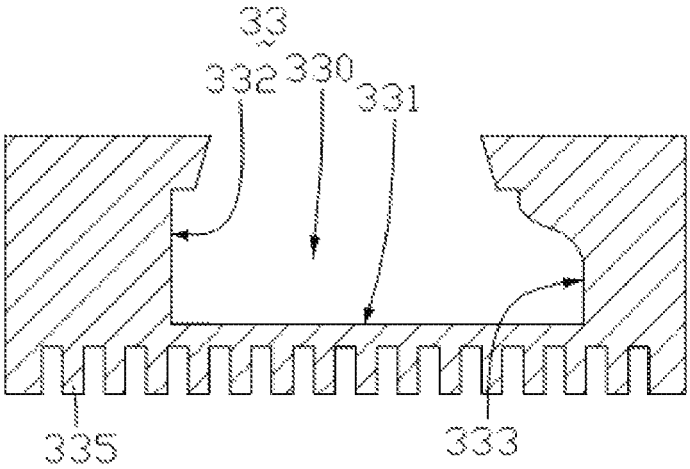
FIG. 4 is a cross-sectional view of a heat dissipating support of FIG. 3.

Referring to FIG. 3 and FIG. 4 together, FIG. 4 is a cross-sectional view of the heat dissipating support 33 of FIG. 3. The heat dissipating support 33 is made of a material with good thermal conductivity, e.g., aluminum or an aluminum alloy. The heat dissipating support 33 comprises a receiving recess 330 and a plurality of fins 335. The receiving recess 330 and the fins 335 are formed on two opposite side surfaces of the heat dissipating support 33 respectively. Of course, according to different condition, the heat dissipating fins 335 may be omitted.

The receiving recess 330 comprises a bottom surface 331, a first side surface 332 and a second side surface 333. Two ends of the bottom surface 331 adjoin a lower end of the first side surface 332 and a lower end of the second side surface 333 respectively. An opening of the receiving recess 330 is formed between upper ends of the first side surface 332 and the second side surface 333. A width of the opening is equal to a distance between the two upper ends, and the width is smaller than a length of the bottom surface 331; i.e., a distance between the lower end of the first side surface 332 and the lower end of the second side surface 333 is greater than the width of the opening. The first side surface 332 is formed to be vertical or inclined from the upper end thereof to the lower end thereof. The second side surface 333 is formed with a stepped structure (not shown) between the upper end thereof and the lower end thereof. Specifically, the receiving recess 330 may have an isosceles trapezoidal, right-angled trapezoidal or T-shaped cross section, and the first side surface 332 and the second side surface 33 may have an arcuated irregular shape. In the present invention, any variants in which the distance across the opening is smaller than the length of the bottom surface 331 of the receiving recess 330 are all covered within the scope of the present invention and, for purpose to disclose the most preferred embodiment, will not be enumerated one by one herein.

The receiving recess 330 of the heat dissipating support 33 correspondingly receives the circuit board 32 and the LEDs 31 therein, and the elastic element 34 is sandwiched between the bottom surface 331 of the receiving recess 330. The circuit board 32 is elastically fixed in the receiving recess 330 of the heat dissipating support 33. Meanwhile, the LEDs 31 are disposed near the opening of the receiving recess 330. In this embodiment, the elastic element 34 is made of an elastic and adhesive material with good thermal conductivity.

It shall be appreciated that, the heat dissipating support 33 shown in FIG. 4 and the aforesaid elastic element 34 jointly form the light source fixing device according to the embodiment of the present invention.

When the light source assembly 30 operates, the circuit board 32 transmits an electric signal to the LEDs 31 and drives the LEDs 31 to emit light. The LEDs 31 emit light beams, which transmit via the opening of the receiving recess 330. On the other hand, heat generated by the LEDs 31 is conducted to the heat dissipating support 33 via the elastic element 34. In this way, the heat can be effectively and timely dissipated to avoid heat accumulation.

In this embodiment, the receiving recess 330 is formed in the heat dissipating support 33 of the light source assembly 30, and the width of the opening of the receiving recess 330 is smaller than the length of the bottom surface 331 of the receiving recess 330, thus forming a fastening structure. By using the side surfaces of the receiving recess 330 as a part of the fastening structure to abut against side surfaces of the circuit board 32, which ensures that the circuit board 32 keeps fixed in a direction perpendicular to the bottom surface 331. Meanwhile, by providing the elastic element 34 to maintain an elastic force between the circuit board 32 and the heat dissipating support 33, which ensures that the circuit board 32 and the heat dissipating support 33 have the same relative positions in the direction perpendicular to the bottom surface 331; and even when the temperature changes, the elastic action of the elastic element 34 can also ensure that the circuit board 32 will not loosen and fall off due to the thermal expansion and contraction effect, thereby improving the reliability of the product.

Figure 5:
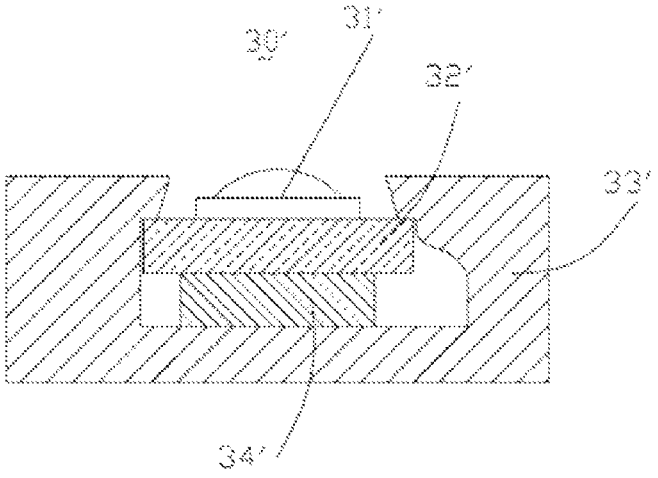
FIG. 5 is a cross-sectional view of a light source assembly according to a second embodiment of the present invention.

FIG. 5 is a cross-sectional view of a light source assembly 30' according to a second embodiment of the present invention. Similar to the light source assembly 30 of FIG. 3, the light source assembly 30' also comprises LEDs 31', a circuit board 32', a heat dissipating support 33' and an elastic element 34'. The difference lies in that, in this embodiment, the LEDs 31' are arranged in one row and the heat dissipating support 33' is not formed with heat dissipating fins on a bottom thereof.

The present invention further provides an assembling method of a light source assembly, which mainly comprises a placing step and a pressing step. In the placing step, a supporting plate of a light emitting element is placed into a receiving recess of a heat dissipating support via an opening of the receiving recess. In the pressing step, the supporting plate is used to press an elastic element in the receiving recess to cause elastic deformation of the elastic element and to have the supporting plate of the light emitting element fixed in the receiving recess, wherein the elastic element is adapted to apply an elastic force on the supporting plate of the light emitting element.

Figure 6:
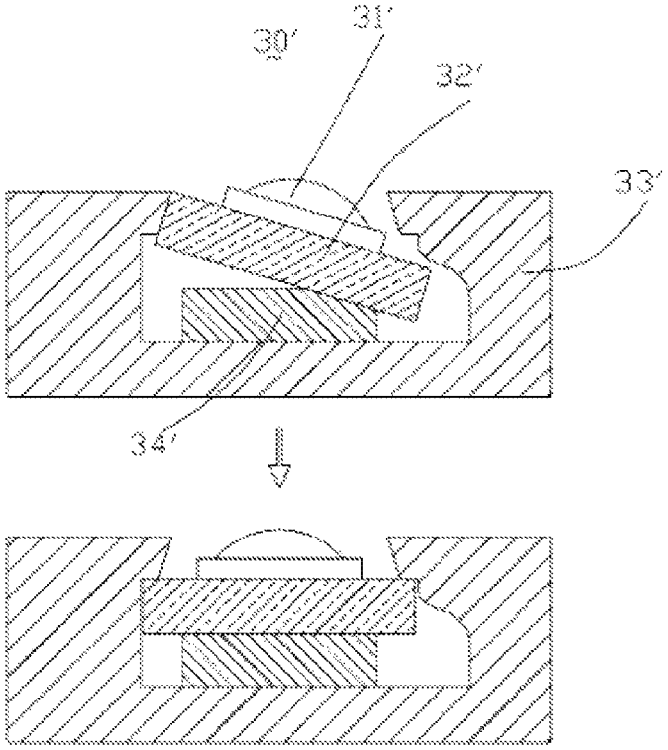
FIG. 6 is a schematic view showing an assembling process flow of the light source assembly of FIG. 5.

FIG. 6 is a schematic view showing an assembling process flow of the light source assembly 30' of FIG. 5. The assembling process flow mainly comprises the following steps.

Firstly, one side of the circuit board 32' is inserted into the receiving recess 330' of the heat dissipating support 33' slantwise via the opening of the receiving recess, and the elastic element 34' in the receiving recess is pressed to cause elastic deformation.

Then, the other side of the circuit board 32' is placed into the receiving recess 330', and the circuit board 32' is adjusted in such a way that the circuit board 32' is fixed in the receiving recess 330', wherein the elastic element 34' is adapted to apply an elastic force on the circuit board 32'.

Figure 7:
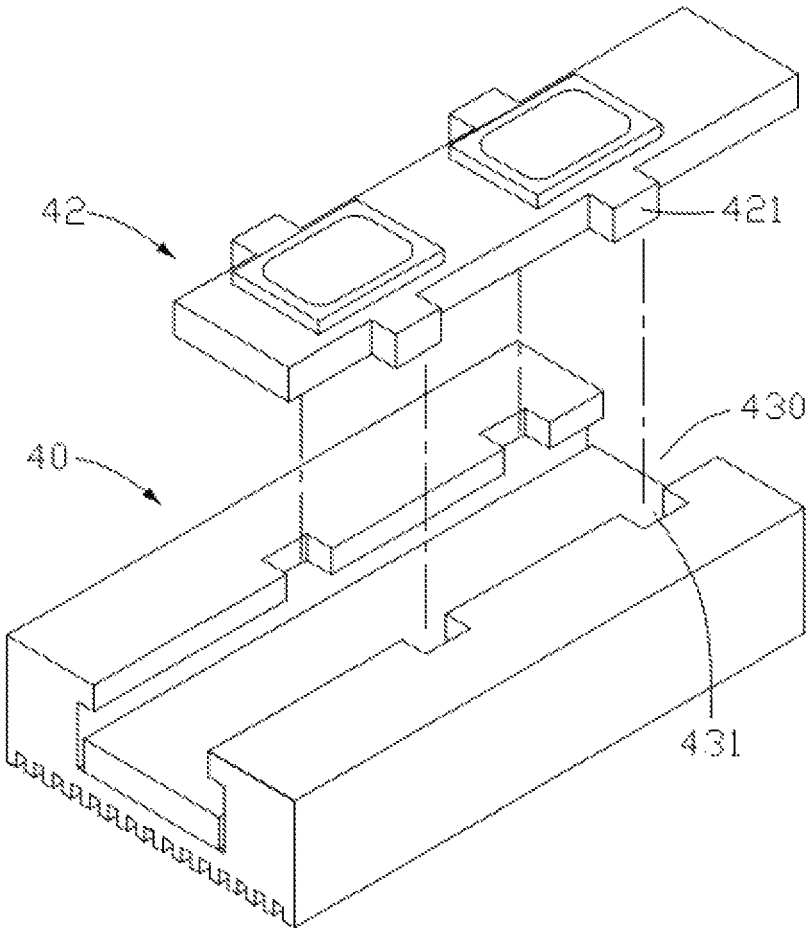
FIG. 7 is a schematic perspective view of a structure of a light source assembly according to a third embodiment of the present invention.
Figure 8:
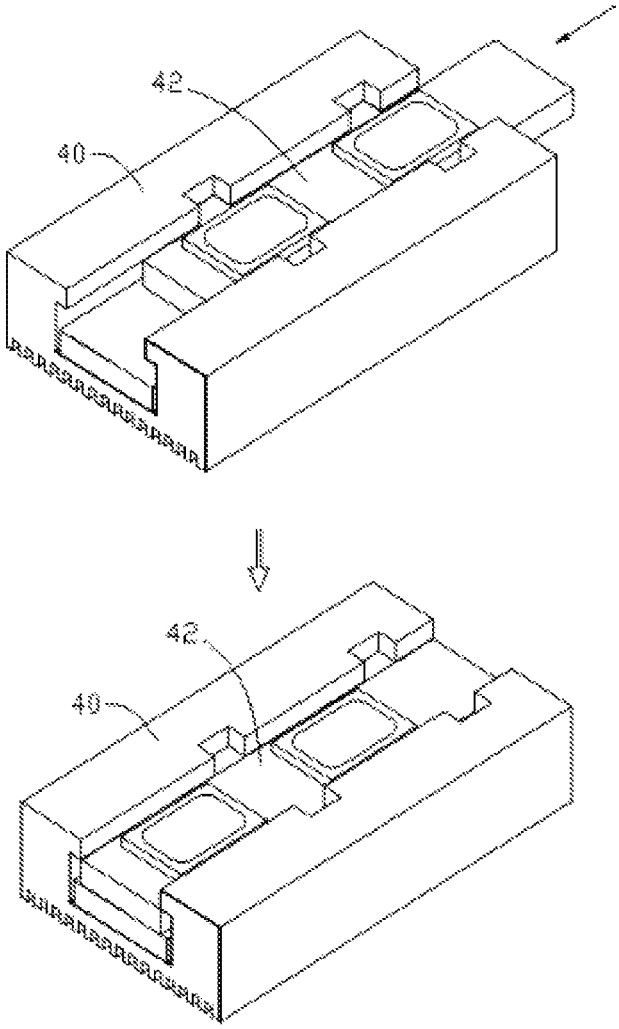
FIG. 8 is a schematic view showing an assembling process flow of the light source assembly of FIG. 7.

Referring to FIG. 7 and FIG. 8 together, FIG. 7 is a schematic perspective view of a structure of a light source assembly according to a third embodiment of the present invention, and FIG. 8 is a schematic view showing an assembling process flow of the light source assembly of FIG. 7.

The light source assembly 40 is substantially the same as the light source assembly 30 in the first embodiment 30 except that: a plurality of grooves 431 is further formed at the opening of the receiving recess 430 of the light source assembly 40, a plurality of protrusions 421 is formed correspondingly at two sides of the circuit board 42, and the protrusions 421 have a profile matching with a profile of the grooves 431. When the light source assembly 40 is assembled, a light emitting element with the protrusions 421 at sides thereof is firstly placed into the opening of the receiving recess 430 in such a way that the protrusions 421 are disposed into the grooves 431; then the elastic element 44 in the receiving recess 430 is pressed to cause elastic deformation, and the circuit board 42 is pushed in a longitudinal direction (as shown by an arrow in FIG. 8) of the opening of the receiving recess 430 so that the protrusions 421 are moved into the receiving recess 430 and abut against an inner wall of the receiving recess 430. Thereby, the circuit board 42 is fixed into the receiving recess 430, and the elastic element 44 applies an elastic force on the circuit board 42.

In the light source assembly 40, the protrusions 421 are formed at the sides of the circuit board 42, the grooves 431 are formed at the opening of the receiving recess 430 and the elastic element 44 is disposed in the receiving recess 430. With this arrangement, the circuit board 42 can be installed in the receiving recess 430 by pressing the elastic element 44 and pushing the light emitting element in such a way that the protrusions abut against the inner wall of the receiving recess 430 to fix the light emitting element in the receiving recess 430. Thereby, it is more convenient for installing the light source assembly 40.

It shall be appreciated that, although the present invention has been illustrated by taking the LED as an example of a light source, the light source to which the present invention applies is not limited to the LED. Specifically, the present invention also applies to cases where a cold cathode fluorescence lamp (CCFL) tube or the like is used as a light source. When the CCFL tube is used as a light source, the aforesaid circuit board has to be correspondingly modified into a supporting plate for supporting the CCFL tube.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A light source fixing device, comprising a heat dissipating support, wherein the heat dissipating support comprises a receiving recess, and wherein the light source fixing device further comprises an elastic element disposed in the receiving recess; wherein the elastic element is arranged on and in contact with a bottom surface of the receiving recess, the light source fixing device is configured for receiving and fixing a light emitting element, the elastic element is independent from both of the light emitting element and the heating dissipating support, and the light emitting element is arranged on the elastic element such that the elastic element is sandwiched between the bottom surface of the receiving recess and the light emitting element;

wherein the receiving recess comprises the bottom surface and two opposite side surfaces, the bottom surface adjoins lower ends of the two side surfaces, an opening of the receiving recess is formed between upper ends of the two side surfaces, a distance between the lower ends of the two side surfaces is greater than a width of the opening, and each of the side surfaces is inclined or arcuated or is formed with a stepped structure from the upper end thereof to the lower end thereof.

2. The light source fixing device of claim 1, wherein the receiving recess has a trapezoidal or T-shaped cross section.

3. The light source fixing device of claim 1, wherein a plurality of grooves is formed at the opening of the receiving recess.

4. The light source fixing device of claim 1, wherein the elastic element is a thermally conductive element.

5. The light source fixing device of claim 1, wherein the elastic element provides an upward elastic force for the light emitting element, such as to fix the light emitting element in the receiving recess.

6. A light source assembly, comprising a light emitting element and a light source fixing device, wherein the light emitting element comprises a light source and a supporting plate for supporting the light source, the light source fixing device comprises an elastic element and a heat dissipating support which comprises a receiving recess, the receiving recess is adapted to receive the elastic element and the supporting plate, the elastic element is arranged on and in contact with a bottom surface of the receiving recess, the elastic element is independent from both of the heating dissipating support and the supporting plate, the supporting plate is arranged on the elastic element such that the elastic element is sandwiched between the bottom surface of the receiving recess and the supporting plate, and the elastic element is adapted to apply an elastic force on the supporting plate so that the supporting plate is fixed in the receiving recess;

wherein the receiving recess comprises the bottom surface and two opposite side surfaces, the bottom surface adjoins lower ends of the two side surfaces, an opening of the receiving recess is formed between upper ends of the two side surfaces, a distance between the lower ends of the two side surfaces is greater than a width of the opening, and each of the side surfaces is inclined or arcuated or is formed with a stepped structure from the upper end thereof to the lower end thereof.

7. The light source assembly of claim 6, wherein the receiving recess has a trapezoidal or T-shaped cross section.

8. The light source assembly of claim 6, wherein the light source is disposed adjacent to the opening of the receiving recess so that a light beam of the light source transmits from the opening.

9. The light source assembly of claim 6, wherein a plurality of grooves is formed at the opening of the receiving recess, a plurality of protrusions is formed at sides of the supporting plate corresponding to the grooves of the receiving recess, and a profile of the protrusions matches with a profile of the grooves, the receiving recess is adapted to receive the supporting plate, the protrusions abut against an inner wall of the receiving recess, and the elastic element is adapted to apply an elastic force on the supporting plate so that the supporting plate is fixed in the receiving recess.

10. The light source assembly of claim 6, wherein the elastic element is a thermally conductive element.

11. The light source assembly of claim 6, wherein the elastic force applied on the supporting plate by the elastic element, is vertically upward, such that the supporting plate is fixed in the receiving recess.

12. An assembling method of a light source assembly, comprising the following steps of:

a placing step, in which a supporting plate of a light emitting element is placed into a receiving recess of a heat dissipating support via an opening of the receiving recess; and a pressing step, in which the supporting plate is used to press an elastic element in the receiving recess to cause elastic deformation of the elastic element and to have the supporting plate of the light emitting element fixed in the receiving recess, wherein the elastic element is adapted to apply an elastic force on the supporting plate of the light emitting element, the elastic element is arranged on and in contact with a bottom surface of the receiving recess, the elastic element is independent from both of the heating dissipating support and the supporting plate, and the supporting plate is arranged on the elastic element such that the elastic element is sandwiched between the bottom surface of the receiving recess and the supporting plate; wherein the receiving recess comprises the bottom surface and two opposite side surfaces, the bottom surface adjoins lower ends of the two side surfaces, an opening of the receiving recess is formed between upper ends of the two side surfaces, a distance between the lower ends of the two side surfaces is greater than a width of the opening, and each of the side surfaces is inclined or arcuated or is formed with a stepped structure from the upper end thereof to the lower end thereof.

13. The assembling method of claim 12, wherein:

in the placing step, one side of the supporting plate is inserted into the receiving recess of the heat dissipating support slantwise via the opening of the receiving recess; and in the pressing step, the elastic element in the receiving recess is pressed to place the other side of the supporting plate into the receiving recess.

14. The assembling method of claim 12, wherein:

in the placing step, a supporting plate with protrusions at sides thereof is placed into the opening of the receiving recess with grooves in such a way that the protrusions are disposed into the grooves; and in the pressing step, the elastic element in the receiving recess is pressed and the supporting plate is pushed so that the protrusions are moved into the receiving recess and abut against an inner wall of the receiving recess.

15. The assembling method of claim 12, wherein the elastic force applied on the supporting plate by the elastic element, is vertically upward, such that the supporting plate is fixed in the receiving recess of the heat dissipating support.

* * * * *